United States Patent [19]

Palluel et al.

[11] Patent Number: 4,494,035

[45] Date of Patent: Jan. 15, 1985

[54] THERMOELECTRIC CATHODE FOR A HYPERFREQUENCY VALVE AND VALVES INCORPORATING SUCH CATHODES

[75] Inventors: Pierre Palluel; Arvind Shroff, both of Paris, France

[73] Assignee: Thomson-CSF, Paris, France

[21] Appl. No.: 318,316

[22] Filed: Nov. 4, 1981

[30] Foreign Application Priority Data

Nov. 7, 1980 [FR] France ..... 80 23884

[51] Int. Cl.[3] ..... H01J 1/14; H01J 19/06; H01K 1/04

[52] U.S. Cl. ..... 313/346 R; 313/346 DC

[58] Field of Search ..... 313/346, 346 DC

[56] References Cited

U.S. PATENT DOCUMENTS

| | | | |
|---|---|---|---|
| 2,813,220 | 11/1957 | Coppola | 313/346 R |
| 3,076,915 | 2/1963 | Gal et al. | 313/346 R |
| 3,244,929 | 4/1966 | Kuhl | 313/346 R |
| 3,373,307 | 3/1968 | Zalm et al. | 313/346 DC |
| 3,558,966 | 1/1971 | Hill | 313/346 R |
| 3,842,309 | 10/1974 | Van Stratum et al. | 313/346 DC |
| 3,911,309 | 10/1975 | Kummel et al. | 313/346 R |
| 4,165,473 | 8/1979 | Falce | 313/346 R |
| 4,310,603 | 1/1982 | Falce | 313/346 R |
| 4,400,648 | 8/1983 | Taguchi et al. | 313/346 R |

*Primary Examiner*—Saxfield Chatmon

*Attorney, Agent, or Firm*—Oblon, Fisher, Spivak, McClelland & Maier

[57] ABSTRACT

This invention concerns a thermoelectronic cathode for hyperfrequency electron tubes.

The cathode comprises a cylindrical molybdenum casing, the lower portion of which contains a heating filament, while the upper portion contains two superimposed porous bodies, the lower one made from impregnated material, and the upper one from non-impregnated material.

11 Claims, 3 Drawing Figures

Figure 1:
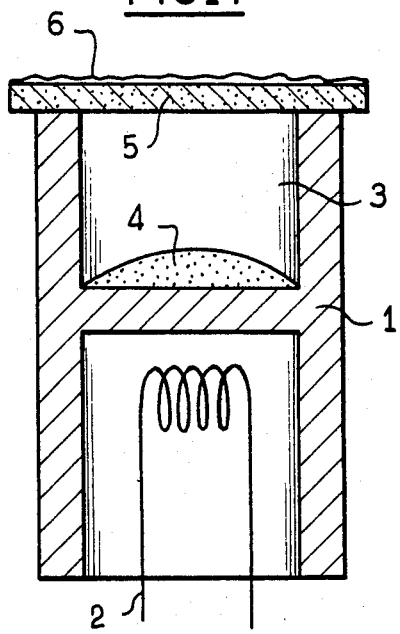
FIG 1 PRIOR ART

THERMOELECTRIC CATHODE FOR A HYPERFREQUENCY VALVE AND VALVES INCORPORATING SUCH CATHODES

This invention concerns a new thermoelectronic cathode. Thermoelectronic cathodes are used in electron valves, valves with localized constants, such as triodes and tetrodes, or valves with distributed constants,such as klystrons and magnetrons for hyperfrequencies.

The invention also concerns electron tubes of this kind.

The power produced by thermoelectronic valves at very high hyperfrequencies is limited by the current density produced by the cathode.

Thermoelectronic cathodes with reserve emissive matter, known as "L" cathodes, have been in use for some time. They comprise a molybdenum tube divided into two cavities. The lower cavity contains the heating element, and the upper cavity, with contains a mixture, for example of barium and calcium carbonate, functions as a barium container. This container is covered with a porous tungsten disc, which provides the only path of communication between the upper cavity and the exterior.

The drawback of such cathodes is that the carbonates have to be converted into oxides, which is a lengthy operation, due to the fact that the reaction gas can escape only through the tungsten disc.

An improvement that has been introduced is direct use of alkaline-earth oxides, instead of carbonates. However, this raises other difficulties, involving the manufacture and storage of such cathodes, since alkaline-earth oxides react so strongly with atmospheric air.

Another improvement consists of replacing the alkaline-earth reserve with a ceramic formed of a mixture of alumina, alkaline-earth oxides and tungsten powder.

Because of these technological problems, those skilled in the art tend to use "impregnated" cathodes, consisting of a tungsten matrix impregnated with varying proportions of barium and calcium aluminates.

However, recorded figures show that "L" cathodes always offer higher emitted current density, at the same temperature, than impregnated cathodes, even in the more favorable cases where these are coated with a film of high extraction energy refractory metal, such as osmium, ruthenium, iridium and rhenium, which tends to increase current density.

This invention concerns a cathode structure in which current density is at least equal to that of an "L" cathode, but which avoids the technological difficulties presented by such cathodes.

This new structure comprises two superimposed porous bodies with the same or different levels of porosity, the lower body being impregnated with subtsances such as barium and calcium aluminates, and the upper body not being impregnated; both porous bodies are brazed inside a molybdenum cover, which ensures their mechanical and thermal solidarity and which also allows the positioning of a heating filament. .

This type of cathode offers several advantages over existing cathodes:

- its simpler technology does not require any complicated equipment, such as transfer machinery to avoid oxides coming into contact with air;
- it can be stored in a neutral atmosphere, since aluminates do not require any special precautions;

- at the start of its useful life, evaporation is non-excessive, because the zone where the barium is created is remote from the surface, and the path it has to follow is always the same; this rate of evaporation is maintained as time passes, because of the constant distance involved;
- electron emission resulting from barium covering is equivalent, or even superior, to that of impregnated cathodes containing similar porous material.

The invention concerns a thermoelectronic cathode which compr1ses cylindrical casing made from a material such as molybdenum, the lower portion of which contains a heating filament, and the upper portion of which contains a cavity filled with a certain quantity of porous body, this cathode being characterized by the fact that this upper cavity comprises two separate superimposed parts, namely a lower part made from porous body impregnated with emissive material, and an upper part made from non-impregnated porous body.

Figure 2:
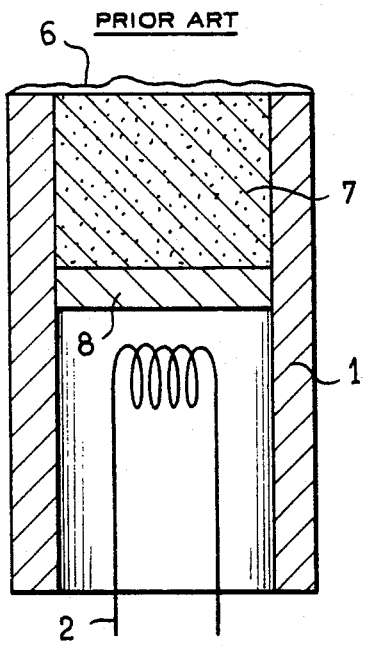
FIG 2 PRIOR ART
Figure 3:
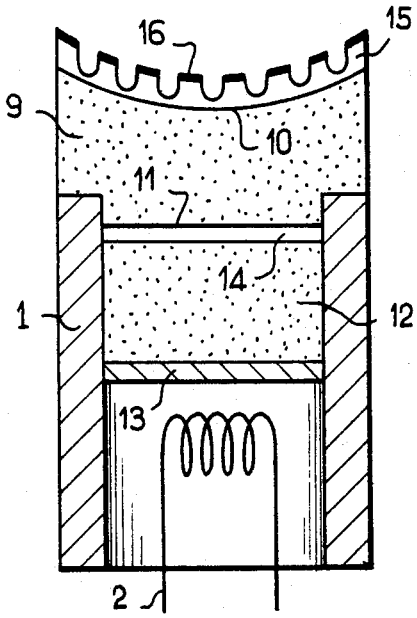

The following description will make the invention clearer, with reference to the accompanying figures:

FIG. 1, showing an L cathode of a type known in the prior art;

FIG. 2, showing an impregnated cathode of a type known in the prior art;

FIG. 3, showing a cathode with the structure described in this invention.

The cathode in FIG. 1 comprises a molybdenum tube 1, divided into two cavities. The lower cavity contains a heating filament 2, and the upper cavity consists of a chamber 3 containing an emissive substance 4, such as barium and ca1cium carbonates.

A porous tungsten disc 5 is fixed to the top of the barium chamber, so that its only communication with the exterior is through this disc.

The upper part of this disc 5 may be covered with a thin layer 6 of a high extraction energy refractory metal such as osmium, rhenium ruthenium, or an alloy of such metals.

The drawback of such cathodes, as already said, is that the carbonates have to be converted into oxides, which is a lengthy operation, because the reaction gas can escape only through the porous disc 5.

The cathode in FIG. 2 comprises a molybdenum cylinder 1, containing a filament 2, and a porous tungsten part 7, impregnated with barium and calcium aluminates. The upper surface of this part 7 may be covered with a thin layer 6 of high extraction energy refractory metal, as mentioned in connection with the cathode in FIG. 1. The lower surface of the porous part 7 rests on a hermetic molybdenum base 8.

The cathode in FIG. 3 possesses the new structure described above. It comprises a cylindrical molybdenum casing 1, the lower portion of which contains a filament 2, and the upper portion of which contains two superimposed porous bodies. The non impregnated upper body 9, with between 16 and 21% porosity, is made from tungsten, or an alloy of tungsten and a refractory metal with high output energy, such as iridium, rhenium, osmium or ruthenium. Emissive matter can be discharged only through the upper surface 10. This is possibly covered with a film 15, by vapour phase deposit of orientated tungsten, thereby producing a series of projecting points which are coated with a layer 16 of anti-emissive material with high output energy. The bottom surface 11 faces the lower porous body 12, which is impregnated with barium and calcium aluminates, or with a mixture of barium and calcium aluminates and scandium oxide or barium scandate. This body may have between 16 and 50% porosity. The lower surface of this part 12 is sealed by standard means, such as by depositing molybdenum-ruthenium brazant, or by providing a molybdenum base 13.

To improve thermal contact, the gap 14 between the two porous body 9 and 12 may be filled either with a conducting metal with high melting point, in powder form, or with a molybdenum or tungsten grid with very fine mesh, for example of a pitch of 20 μm, which provides additional conductivity, to diffuse barium in the direction of the non-impregnated body 9, or with a flexible foil to provide contact between the parts, or with a filtering mat. The gap may be eliminated by using pressing techniques to manufacture the tube, and impregnating only the lower body 12, or impregnating the whole upper portion, and eliminating excess impregnating agent in the upper body 9, by chemical attack.

The top of the upper body 9 is usually curved, this shape being obtained by machining or pressing.

Other embodiments of the invention comprise use in a magnetron or girotron.

This cathode operates as follows. Free barium is produced inside the impregnated body 12, when the cathode is heated by the filament 2, by chemical reaction between the impregnating agent and tungsten.

The barium moves through the pores in the non-impregnated body 9, from the lower surface 11 to the upper surface 10, where it covers the surface, thereby reducing its extraction energy.

Electrons emitted by this cathode are collected by an electrode (not shown in FIG. 3), placed opposite it at a certain distance, and raised to a positive potential in relation to the cathode.

What is claimed is:

1. A thermoelectronic cathode comprising a cylindrical casing separated by a wall in two portions, the lower portion containing a heating filament and the upper portion forming a cavity chamber containing a porous body impregnated with emissive material covered by a non-impregnated body, wherein a conducting metal in powder form having a high melting point is provided between the impregnated porous body and the non-impregnated porous body, and wherein the porosity of the non-impregnated body is between 16 and 21% and the porosity of the impregnated body is between 16 and 50%.

2. The thermoelectronic cathode of claim 1, in which the impregnated body is tungsten impregnated with scandium oxide and a mixture of barium and calcium aluminates.

3. The thermoelectronic cathode of claim 1, in which the impregnated body is tungsten impregnated with a mixture of barium and calcium aluminates and barium scandate.

4. The thermoelectronic cathode of claim 1, wherein a layer of tungsten comprising sunken parts and projecting parts is deposited on the non-impregnated body.

5. The thermoelectronic cathode of claim 1, wherein a layer of tungsten comprising sunken parts and projecting parts is deposited on the non-impregnated body, said projecting parts being covered with a high extraction energy refractory material.

6. A thermoelectronic cathode comprising a cylindrical casing separated by a wall in two portions, the lower portion containing a heating filament and the upper portion forming a cavity chamber containing a porous body impregnated with emissive material covered by a non-impregnated body, wherein a molybdenum or tungsten grid of very fine mesh is provided between the impregnated porous body and the non-impregnated porous body, and wherein the porosity of the non-impregnated body is between 16 and 21% and the porosity of the impregnated body is between 16 and 50%.

7. The thermoelectronic cathode of claim 6, wherein a layer of tungsten comprising sunken parts and projecting parts is deposited on the non-impregnated body.

8. The thermoelectronic cathode of claim 6, wherein a layer of tungsten comprising sunken parts and projecting parts is deposited on the non-impregnated body, said projecting parts being covered with a high extraction energy refractory material.

9. A thermoelectronic cathode comprising a cylindrical casing separated by a wall and two portions, the lower portion containing a heating filament and the upper portion forming a cavity chamber containing a porous body impregnated with emissive material covered by a non-impregnated body, wherein a flexible metal foil is provided between the impregnated porous body and the non-impregnated porous body, and wherein the porosity of the non-impregnated body is between 16 and 21% and the porosity of the impregnated body is between 16 and 50%.

10. The thermoelectronic cathode of claim 9, wherein a layer of tungsten comprising sunken parts and projecting parts is deposited on the non-impregnated body.

11. The thermoelectronic cathode of claim 9, wherein a layer of tungsten comprising sunken parts and projecting parts is deposited on the non-impregnated body, said projecting parts being covered with a high extraction energy refractory material.

* * * * *